US006532782B2

(12) United States Patent
Chiu

(10) Patent No.: US 6,532,782 B2
(45) Date of Patent: Mar. 18, 2003

(54) DETACHABLE LOCK CORE

(76) Inventor: Ming-Hsiang Chiu, No. 8-22, Hsin-Chuang, Mei-Yuan Li, Chia-I City (TW)

( * ) Notice: Subject to any disclaimer, the term of this patent is extended or adjusted under 35 U.S.C. 154(b) by 0 days.

(21) Appl. No.: 09/835,622

(22) Filed: Apr. 17, 2001

(65) Prior Publication Data

US 2002/0148263 A1 Oct. 17, 2002

(51) Int. Cl.[7] ..... E05B 27/00

(52) U.S. Cl. ..... 70/369; 70/371; 70/375; 70/367

(58) Field of Search ..... 70/369, 371, 375, 70/493, 367, 368

(56) References Cited

U.S. PATENT DOCUMENTS 3,564,879 A * 2/1971 Bennett ..... 70/232
4,630,457 A * 12/1986 Kincaid et al. ..... 70/369
5,161,397 A * 11/1992 Raybary ..... 70/374
5,431,034 A * 7/1995 Fann et al. ..... 70/369
5,964,110 A * 10/1999 Crocco et al. ..... 70/369
6,076,386 A * 6/2000 Etchells et al. ..... 70/369
6,089,059 A * 7/2000 Fan ..... 70/371

* cited by examiner

*Primary Examiner*—Lynne H. Browne
*Assistant Examiner*—John B. Walsh
(74) *Attorney, Agent, or Firm*—Staas & Halsey LLP

(57) ABSTRACT

A detachable lock core has a housing. The housing has an opening, a ridge longitudinally formed thereon a plurality of first apertures defined through the ridge, a plurality of upper pins and resilient members respectively received in the first apertures, and at least one channel longitudinal defined in an inner wall thereof. The body is received in the housing. When a correct key is inserted in the key hole in the body to turn the body, the protrusion is received in the channel to enable the body to be detached from the housing.

4 Claims, 8 Drawing Sheets

DETACHABLE LOCK CORE

BACKGROUND OF THE INVENTION

1. Field of the Invention

The present invention is related to a lock, and more particularly to a detachable lock core.

2. Description of Related Art

Referring to FIGS. 13–15, a conventional lock is composed of a housing (50), a first tube (60) and a second tube (70). The first tube (60) is inserted in the housing (50) via a first end of the housing (50) and the second tube (70) is inserted in the housing (50) via a second end of the housing (50). A plurality of first apertures (52) is radially defined in the housing (50) and a plurality of second apertures (62) is radially defined in the first tube (60), and in alignment with the first apertures (52), respectively. A plurality of upper pins (92) and a plurality of lower pins (91) are respectively received in the first apertures (52) and the second apertures (62). Furthermore. each of the first apertures (52) has a resilient member (93) received therein.

The first tube (60) and the second tube (70) respectively have a first key hole (61) and a second key hole (71) in alignment with each other. An opening (72) is defined at a first end of the second tube (70) to receive a first end of the first tube (60) facing the second tube (70) therein. A first orifice (73) and a second orifice (74) are radially defined in the second tube (70) and in communication with the opening (72). The first tube (60) has a notch (not numbered) defined at the first end thereof and in alignment with the first orifice (73). A pin (94) is received in the orifice (73) and the notch. The second orifice (74) is aligned with the second aperture (62) which is defined at the first end of the first tube (60).

When a first key (80) is inserted in the key holes (61, 71) to align the interface between the lower pins (92) and the upper pins (91) with the inner wall of the housing (50), the first tube (60) and the second tube (70) can be turned about the housing (50). When a second key (not shown or numbered) is inserted in the key holes (61, 71), the lower pin (91) at the first end of the first tube (60) is not pushed up, and the corresponding upper pin (92) is still inserted in the second orifice (74). In this case, the first tube (60) can be turned about the second tube (70) and detached from the housing (50).

A user must prepare at least two keys respectively to unlock and detach the lock core, which is very inconvenient. Furthermore, when the first tube (60) is detached from the housing (50), the lower pins (91) may be faced downward and will escape from the second apertures (62).

Therefore, the invention provides an improved lock core to mitigate and/or obviate the aforementioned problems.

SUMMARY OF THE INVENTION

The main objective of the invention is to provide a lock core which is convenient for a user to detach.

Other objects, advantages and novel features of the invention will become more apparent from the following detailed description when taken in conjunction with the accompanying drawings.

DETAILED DESCRIPTION OF THE PREFERRED EMBODIMENT

Figure 1:
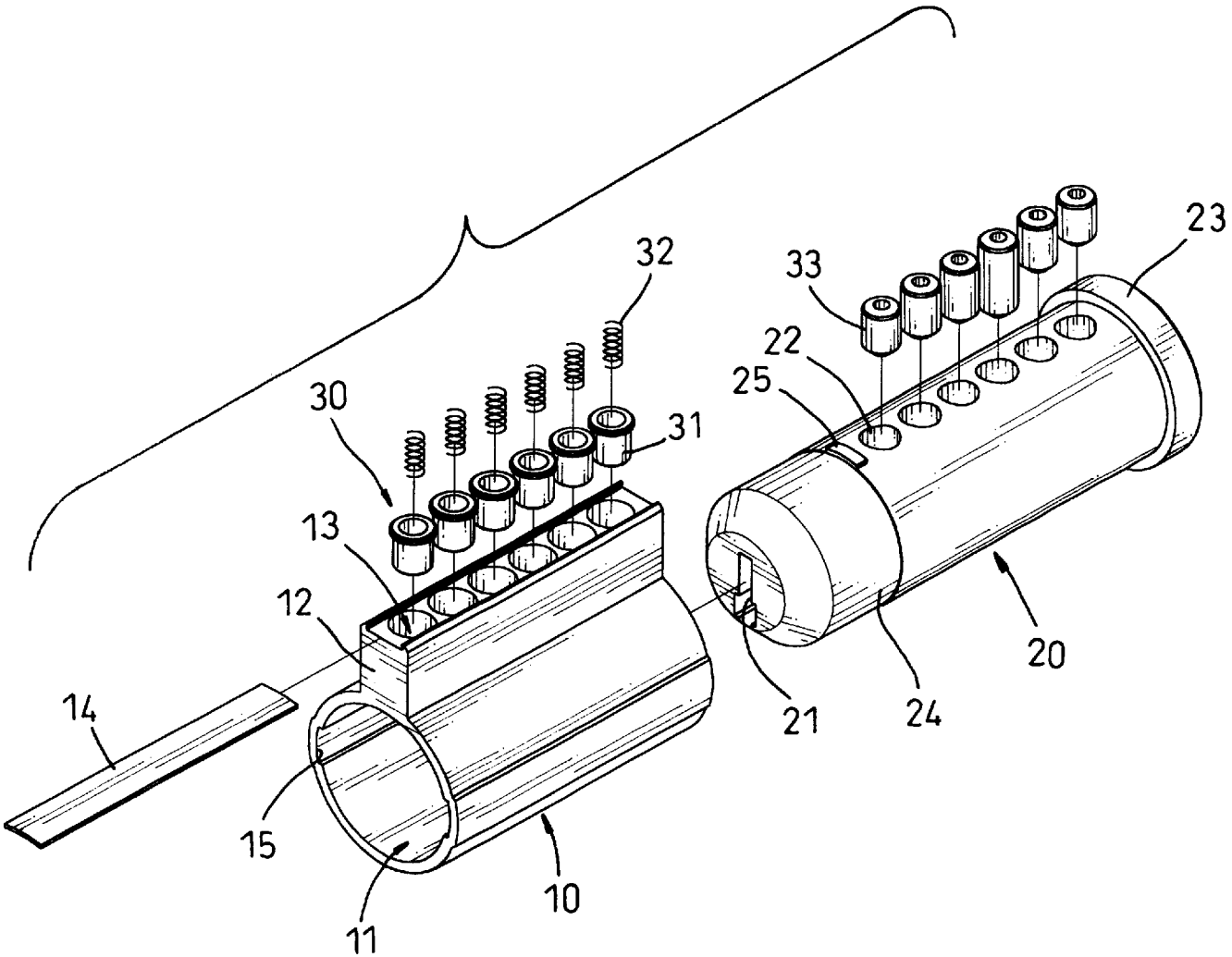
FIG. 1 is an exploded perspective view of a first embodiment of a lock core in accordance with the invention.
Figure 2:
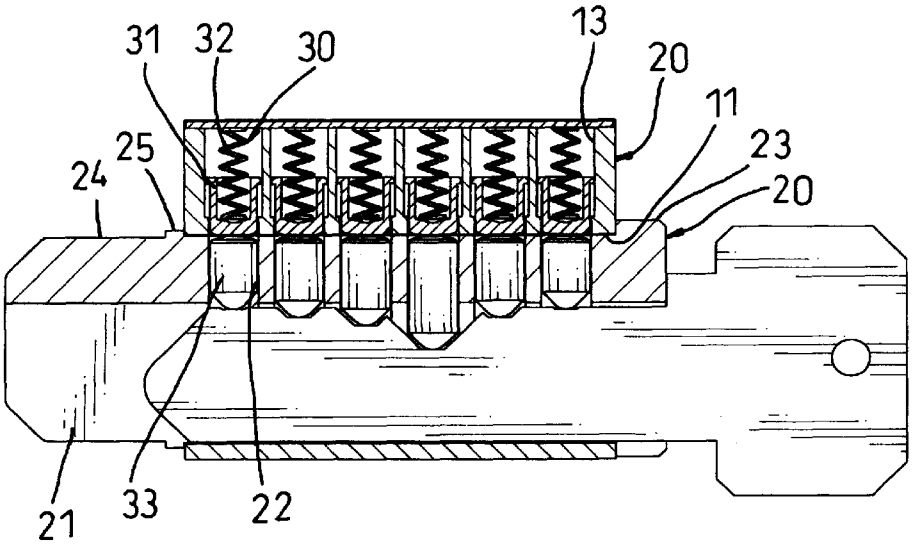
FIG. 2 is a cross sectional view of the lock core in FIG. 1.

Referring to FIGS. 1 and 2, in a first embodiment in accordance with the invention, a lock core comprises a housing (10), and a body (20) received in the housing (10).

The housing (10) has an opening (11) defined therethrough for receiving the body (20) therein. A ridge (12) is longitudinally formed at an outer periphery of the housing (10), and a plurality of first pin holes (13) is radially defined through the ridge (12) and in communication with the opening (11). An identical plurality of upper pins (31) and resilient members (32) are respectively received in the pin holes (13). A cover (14) is provided at a top of the ridge (12) to secure the upper pins (31) and resilient members (32). Two channels (15) are defined at diametrically opposite sides of the housing (10) and substantially perpendicular to the ridge (12).

The body (20) has a key hole (21) longitudinally defined therethrough and a plurality of second pin holes (22) radially defined therein and in communication with the key hole (21) and respectively in alignment with the first pin holes (13). A plurality of lower pins (33) is respectively received in the second pin holes (22) and upper ends of the lower pins (33) are respectively abutted against lower ends of the upper pins (31). A flange (23), of which a diameter is larger than that of the opening (11), is formed at a first end of the body (20). At least one protrusion (25), which can be received in the channels (15), is formed at a second end (24) of the body (20) and is substantially aligned with the second pin holes (22). The flange (23) and the protrusions (25) are respectively abutted against a first end and a second end of the housing (10) to secure the body (20) in the housing (10).

Figure 3:
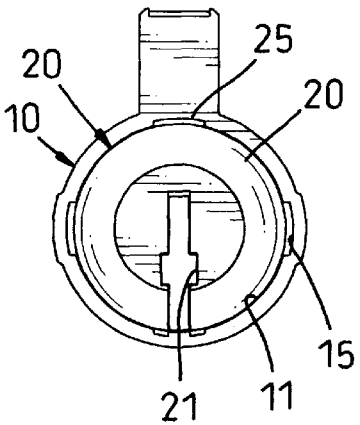
FIG. 3 is a side view of the lock core in FIG. 1 in assembly.
Figure 4:
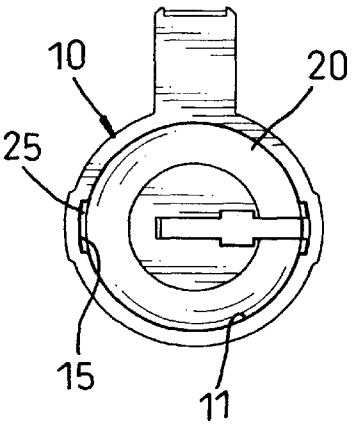
FIG. 4 is a side view showing that the lock core is ready to be detached.

Referring to FIGS. 2, 3 and 4, when a correct key is inserted in the key hole (21), the upper pins (31) are pushed in the first pin holes (13) and the body (20) is able to be rotated about the housing (10). When the body (20) is turned to align the protrusion (25) with one of the channels (15), the protrusion (25) can be moved along the channel (15) and then the body (20) is detached from the housing (10). Afterwards, the lower pins (33) are replaced with another series and the body (20) is extended through the housing (10) and reversedly turned to return to the original status.

Figure 5:
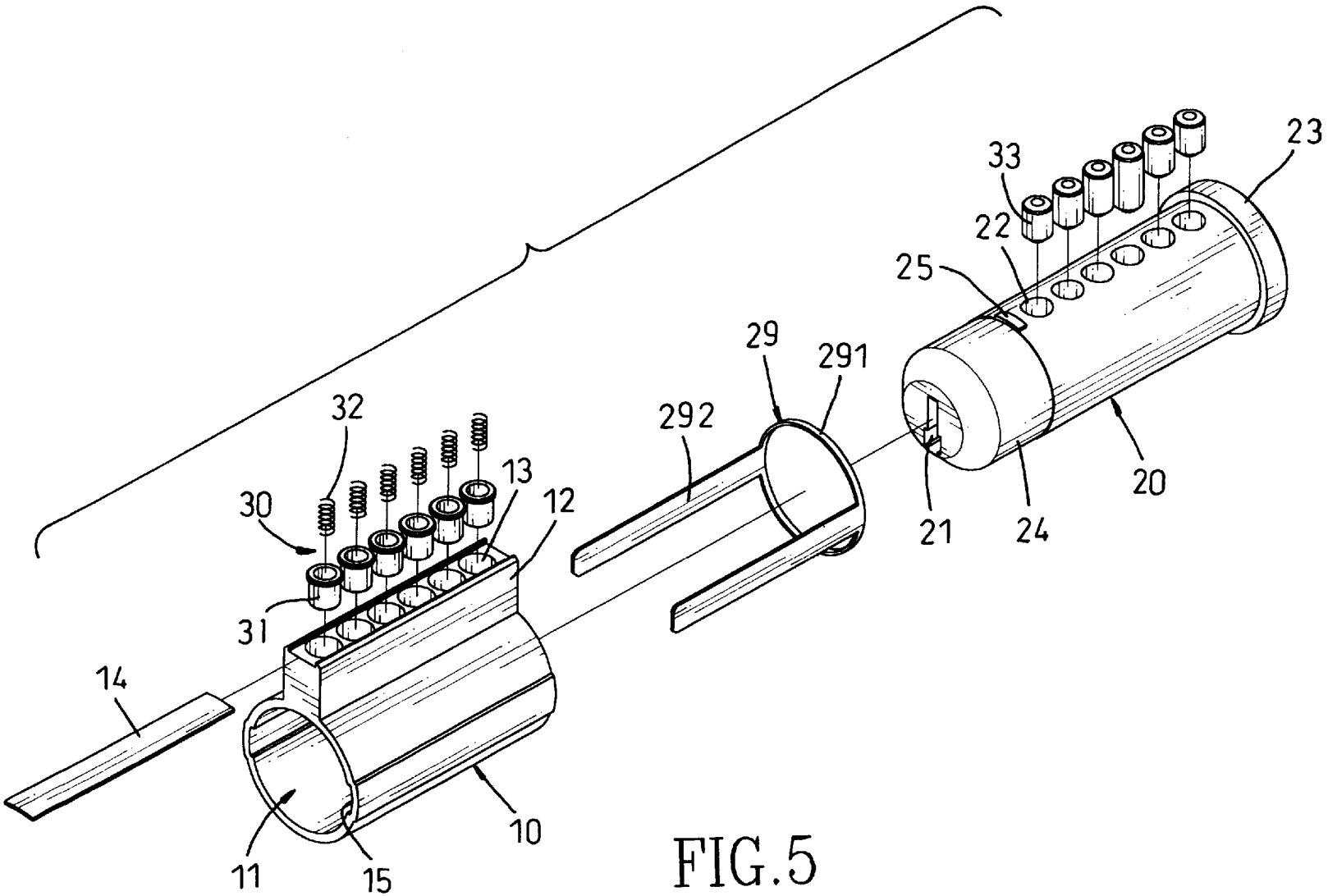
FIG. 5 is an exploded perspective view of a second embodiment in accordance with the invention.

In a second embodiment shown in FIG. 5, the lock core further comprises a protection (29) provided on the body (20). The protection (29) is composed of a ring (291) and two fingers (292). The ring (291) abuts the flange (23) and the fingers (292) are respectively aligned with the channels (15). When the body (20) is turned to align the protrusion (25) with the channel (15), the second apertures (22) are covered by one of the fingers (292) to prevent the lower pins (33) from escaping therefrom.

Figure 6:
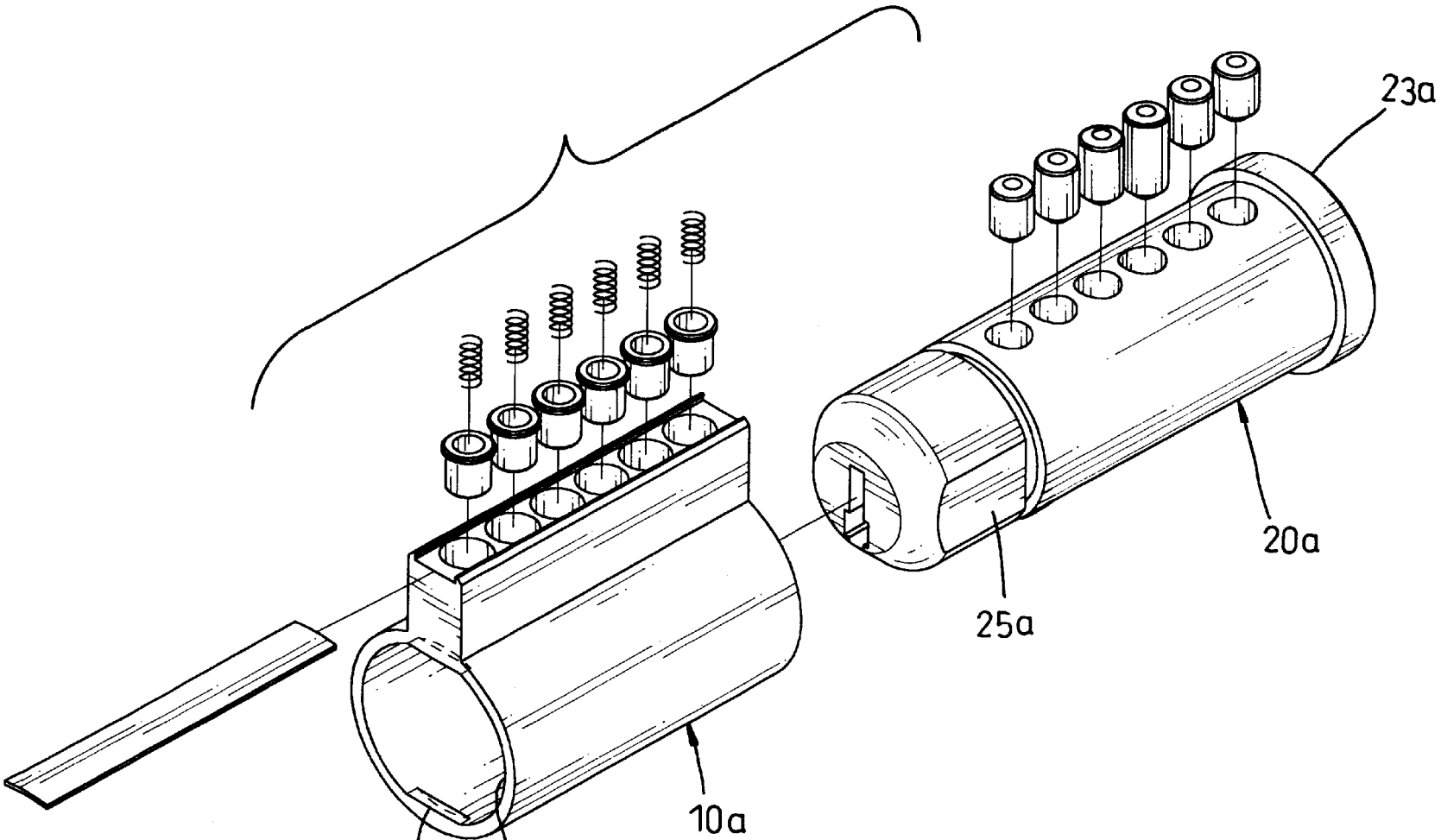
FIG. 6 is an exploded perspective view of a third embodiment in accordance with the invention.
Figure 7:
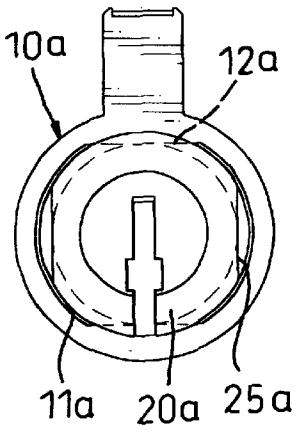
FIG. 7 is a side view of the lock core in FIG. 6 in assembly.

Referring to FIGS. 6 and 7, in a third embodiment of the invention, the housing (10*a*) has two stops (15*a*) defined on diametrically opposite sides of a rear end (11*a*) thereof. The body (20*a*) has at least one notch (25*a*) longitudinally defined at the second end thereof. When the body (20*a*) is turned to align the notch (25*a*) with one of the stops (15*a*), the body (20*a*) is able to be detached from or assembled in the housing (10*a*).

Figure 8:
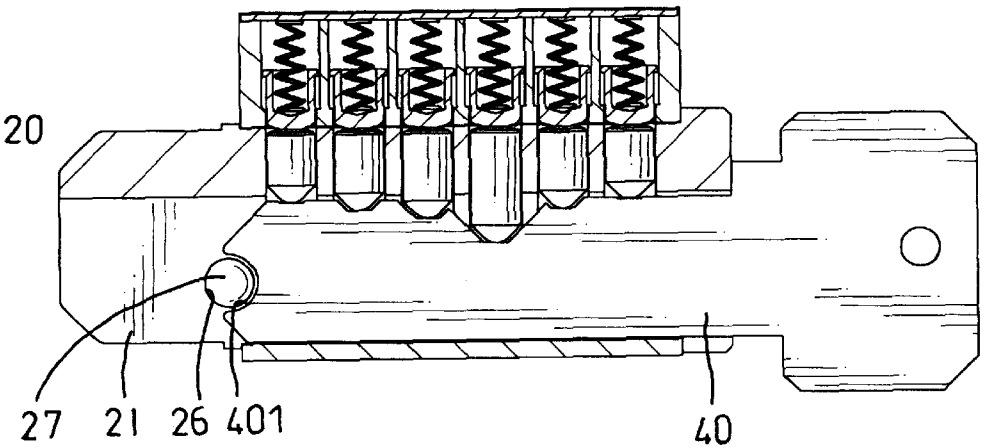
FIG. 8 is a cross sectional view of a fourth embodiment having a latch.
Figure 9:
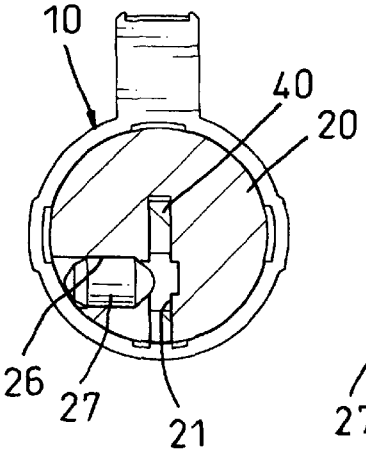
FIG. 9 is a side view of the fourth embodiment in FIG. 8.
Figure 11:
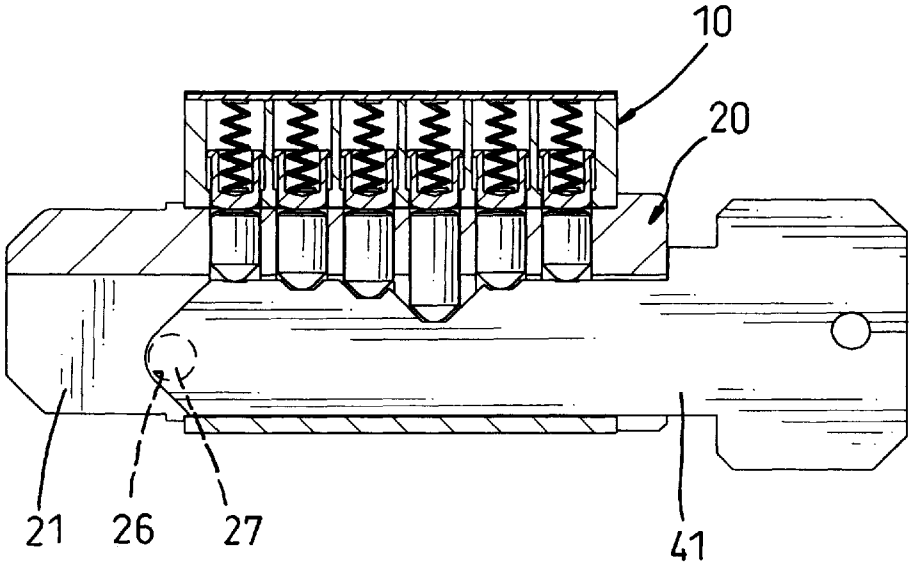
FIG. 11 is a sectional view showing a general key inserted in the lock core.
Figure 12:
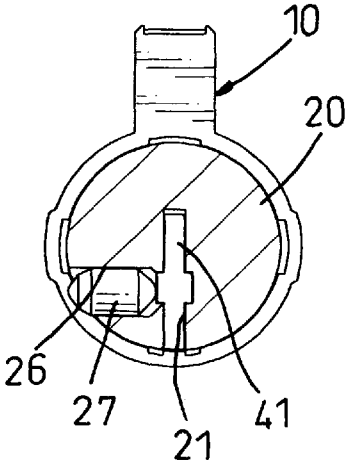
FIG. 12 is a side view of FIG. 11.
Figure 13:
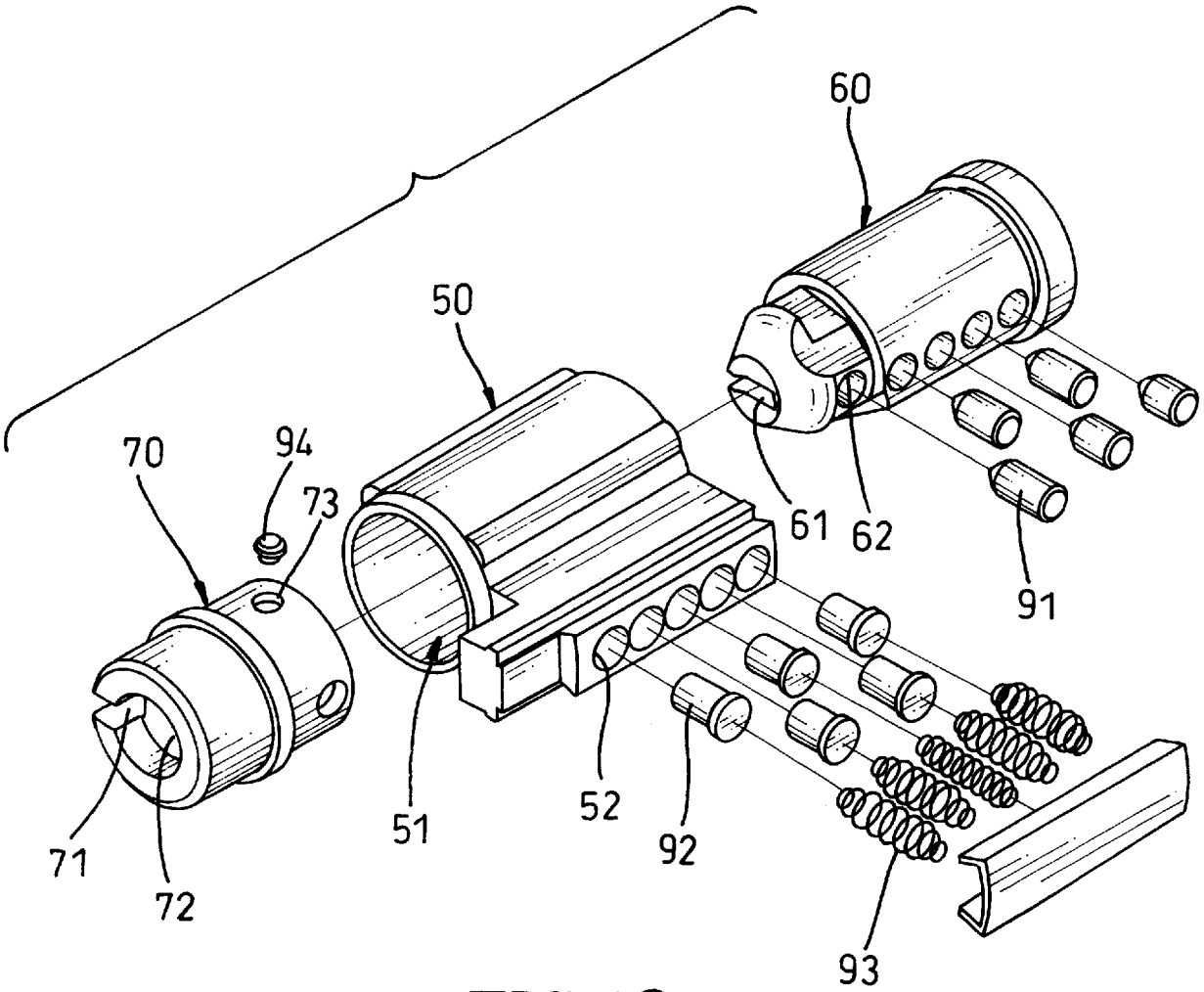
FIG. 13 PRIOR ART
FIG. 13 is an exploded perspective view of a conventional lock core.
Figure 14:
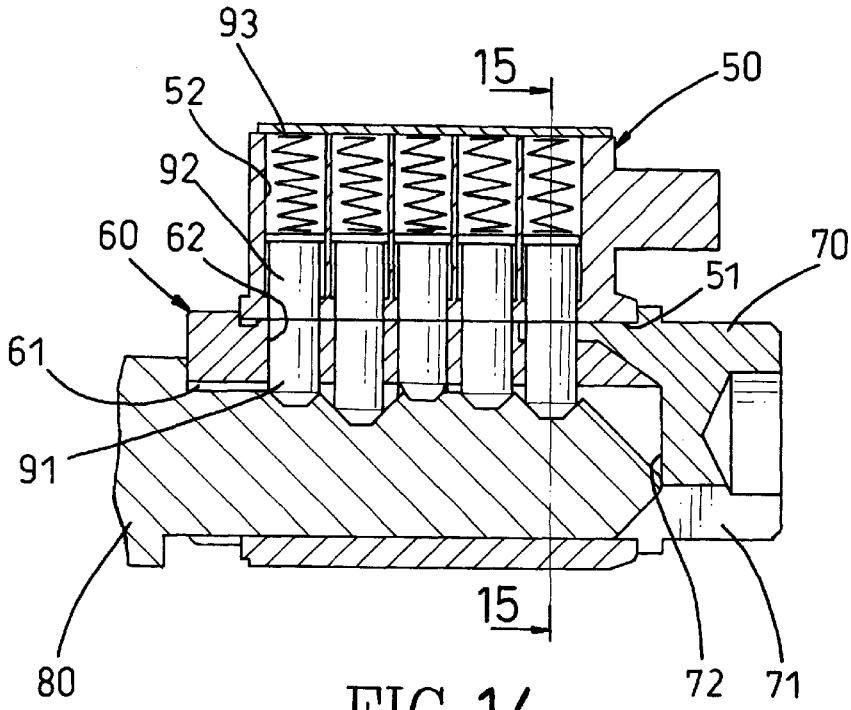
FIG. 14 PRIOR ART
FIG. 14 is a cross sectional view of FIG. 13.
Figure 15:
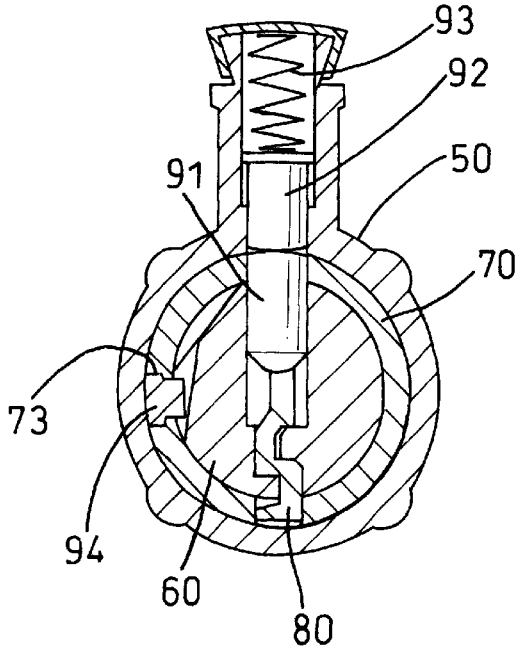
FIG. 15 PRIOR ART
FIG. 15 is a side view of FIG. 13.

Referring to FIGS. 8 and 9, in a fourth embodiment in accordance with the invention, the body (20) has an orifice (26) radially defined at the second end (24) thereof and in communication with the key hole (21). A latch (27) is received in the orifice (26). A special key (40), which is designed for the lock core, has a recess (401) defined at a front end thereof. When the special key (40) is inserted in the key hole (21), a front end of the key (40) does not touch the latch (40), and the body (20) is able to be detached from the housing (10). When a general key (41) is inserted in the key hole (21), as shown in FIGS. 11 and 12, the latch (40) is pushed outwards by a front end of the key (41) to block the body (20) exiting from the housing (10).

Figure 10:
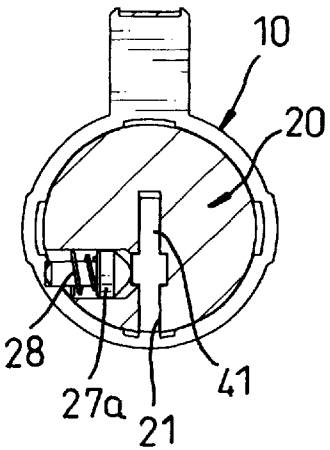
FIG. 10 is a side view showing the lock core having another latch.

Furthermore, in a fifth embodiment shown in FIG. 10, the latch (27*a*) has a spring (28) provided thereon.

From the above description, it is noted that the invention has the following advantages:

1. Because the structure of the lock core in accordance with the invention is simple, the manufacturer is able to produce the product at a low cost.
2. It is convenient for a user to detach the lock core by using only one key.
3. Because the lower pins are covered by the protection, the lower pins will not escape from the second apertures when the body is detached from the housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A detachable lock core comprising:

a housing, having an opening defined therethrough, a ridge longitudinally formed at an outer periphery thereof, a plurality of first apertures defined through the ridge, an identical plurality of upper pins and resilient members respectively received in the first apertures, and at least one channel longitudinally defined in an inner wall thereof; and a body received in the housing, the body having a key hole defined therethrough, a plurality of second apertures radially defined therein, a plurality of lower pins respectively received in the second apertures, a flange formed at a first end thereof, a second end extending through the opening, and at least one protrusion formed at the second end and extending out of the housing, whereby, when a correct key is inserted in the key hole to turn the body about the housing, the protrusion is received in the channel to enable the body to be detached from the housing.

2. The detachable lock core as claimed in claim 1, further comprising a ring provided on the body, and at least one finger formed on the ring and received in the channel.

3. The detachable lock core as claimed in claim 1, wherein the body further has an orifice radially defined at the second end and in communication with the key hole, and a latch is received in the orifice.

4. The detachable lock core as claimed in claim 3, wherein the latch has a spring provided thereon.

* * * * *